US005409395A

United States Patent [19]

Okada

[11] Patent Number: 5,409,395

[45] Date of Patent: Apr. 25, 1995

[54] CONNECTOR

[75] Inventor: Hajime Okada, Yokkaichi, Japan

[73] Assignee: Sumitomo Wiring Systems, Ltd., Yokkaichi, Japan

[21] Appl. No.: 160,786

[22] Filed: Dec. 3, 1993

[30] Foreign Application Priority Data

Dec. 7, 1992 [JP] Japan ..... 4-084123 U

[51] Int. Cl.[6] ..... H01R 13/627

[52] U.S. Cl. ..... 439/354

[58] Field of Search ..... 439/345, 350, 353, 354, 439/357, 372

[56] References Cited

U.S. PATENT DOCUMENTS 4,010,998 3/1977 Tolnar, Jr. et al. .
4,392,706 7/1983 Baker et al. ..... 439/353
4,925,398 5/1990 Samejima et al. ..... 439/350 X
4,944,693 7/1990 Puerner ..... 439/357 X
5,110,302 5/1992 Kobler ..... 439/357

*Primary Examiner*—Khiem Nguyen
*Attorney, Agent, or Firm*—Sandler, Greenblum & Bernstein

[57] ABSTRACT

A flexible arm with a locking ramp is mounted on a plug connector in a resiliently swingable manner. The locking ramp abuts against a locking latch formed on the receptacle connector when the plug unit is inserted in the socket hole formed in a receptacle. Further pressing of the plug unit causes the locking latch to press down the locking ramp so that the plug and receptacle units are perfectly disengaged from each other until the peak of the locking ramp exceeds the bottom of the locking latch. Thus, the connector is forcibly and automatically re-set at a pre-engagement position where the terminals are non-conductive when the connector is not completely engaged.

3 Claims, 4 Drawing Sheets

CONNECTOR

BACKGROUND OF THE INVENTION

1. Field of the Invention

The present invention relates to a connector having mating units for making an engagement of terminals accommodated therein and, more particularly, to a connector which forcibly sets the mating units at a pre-engagement position in which the terminals are not electrically connected when the terminals are incompletely engaged so as to prevent the terminals from temporarily connecting with each other.

2. Description of the Prior Art

In FIGS. 7, 8, and 9, a conventional connector is shown. The connector Cp includes a receptacle unit 2 with a male terminal 1 accommodated therein and a plug unit 4 with a female terminal 3 accommodated therein. The plug unit 4 is inserted into an insertion hole 2*a* formed on the front side of the receptacle unit 2 such that a forward end 1*c* of male terminal 1 moves toward an internal element 3*c* of female terminal 3, as shown in FIG. 7.

During this operation, a projection 4*b* formed in a trapezoid shape on the upper surface of a flexible arm 4*a* abuts an engaging part 2*b* formed in the open end of the insertion hole 2*a*. Further insertion of the plug unit 4 causes the engaging part 2*b* to press the flexible arm 4*a* downward, and the forward end 1*c* of the male terminal 1 contacts the internal element 3*c*, as shown in FIG. 8.

When the projection 4*b* completely passes through the engaging part 2*b*, the flexible arm 4*a* rises up so that the engaging part 2*b* fits in a locking cavity 2*c* formed backside of the engaging part 2*b*, and thus the receptacle and plug units 2 and 3 are locked at this lock position. At this lock position, the terminals 1 and 3 are connected to each other securely, as shown in FIG. 9.

When this kind of connector Cp in such conditions shown in FIGS. 7 or 8 is installed in the automobile, the plug unit 4 which is not locked by the engaging members 4*b* and 2*c* is likely to accidentally be removed from the receptacle unit 2 due to the vibrations mainly occurring while the automobile drives. Such a connector Cp in which the terminals 1 and 3 are completely separated and non-conductive, as shown in FIG. 7, can be easily detected by the quality inspection of the automobile, and it is possible to recover the disengagement.

However, such a connector Cp in which the terminals 1 and 3 are temporality connected, as shown in FIG. 8, can not be detected by the automobile's quality inspection, because the terminals 1 and 3 are conductive. Therefore, thus incompletely engaged connector which has passed the quality inspection may disengage so that the terminals 1 and 3 become non-conductive during the driving of the automobile, sometimes causing serious accidents. Finally, this temporarily engaged plug unit 4 completely removes from the receptacle unit 2.

SUMMARY OF THE INVENTION

The object of the present invention is therefore to provide a connector which solves these problems.

The present invention has been developed with a view to substantially solving the above described disadvantages and has for its essential object to provide an improved connector.

In order to achieve the aforementioned objective, a connector for the connection of first and second connector members comprises flexible arm means provided on said first connector member, said flexible arm means being provided with first engaging means; and second engaging means provided on said second connector member, said second engaging means being engagable to said first engaging means, said first engaging means being movable between a first predetermined position, in which said first engaging means is pressed by said second engaging means to enable disengagement of said first connector member from said second connector member, and a second predetermined position, in which said first engaging means is pressed by said second engaging means to enable engagement of said first connector member with said second connector member.

BRIEF DESCRIPTION OF THE DRAWINGS

These and other objects and features of the present invention will become clear from the following description taken in conjunction with the preferred embodiment thereof with reference to the accompanying drawings throughout which like parts are designated by like reference numerals, and in which.

DETAILED DESCRIPTION OF THE PREFERRED EMBODIMENT

Figure 1:
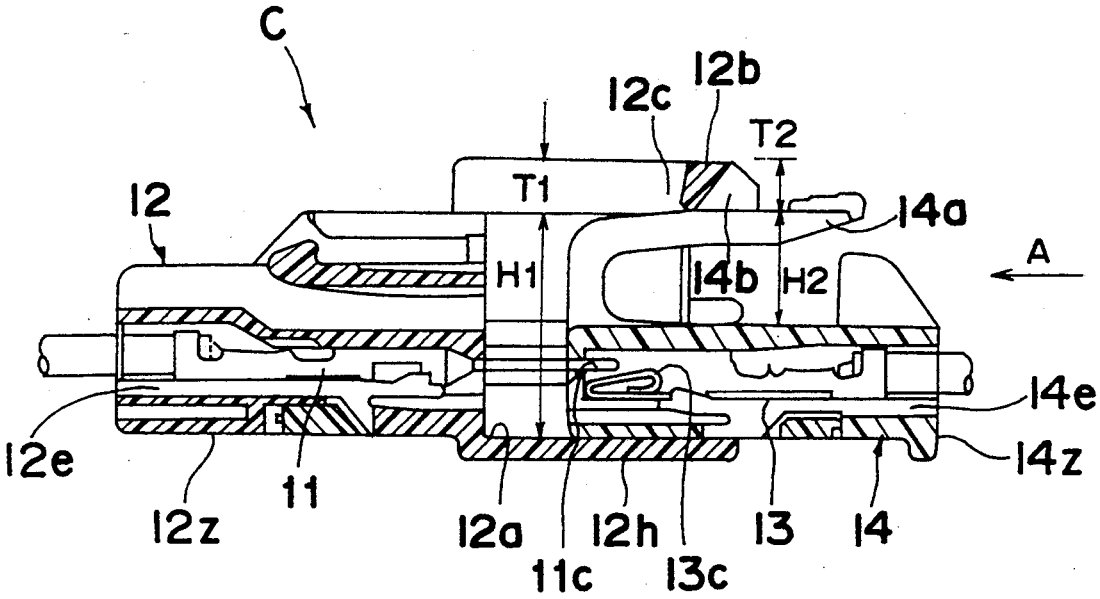
FIG. 1 is a cross-sectional view showing a connector according to an embodiment of the present invention, in which a plug unit is inserted into a receptacle unit for an engagement therebetween.
Figure 2:
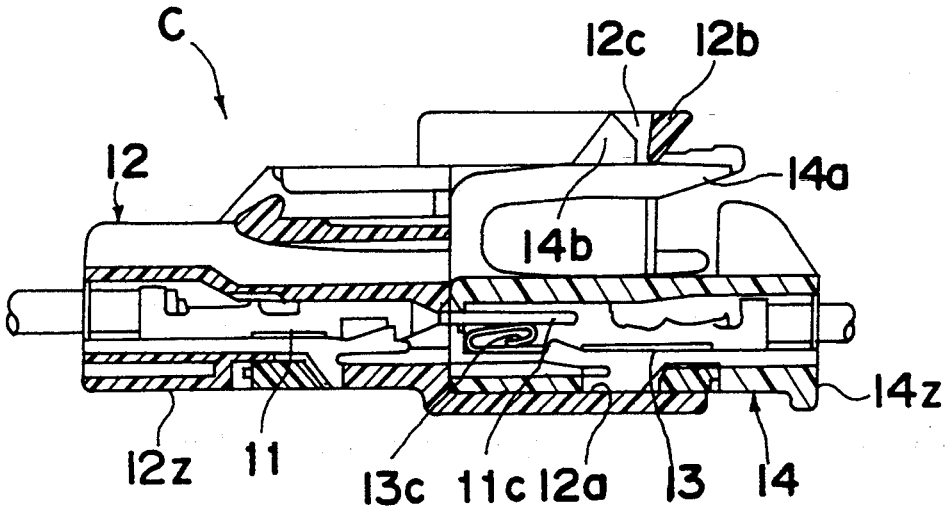
FIG. 2 is a cross-sectional view showing the connector of FIG. 1, in which plug and receptacle units are completely engaged.

Referring to FIG. 1, a connector according to an embodiment of the present invention is shown. The connector C includes a matable pair of plug unit 14 and receptacle unit 12. The receptacle unit 12 has a plurality, for example six, of male terminals 11 accommodated therein, and the plug unit 14 has a plurality of female terminals 13 corresponding to male terminals 11 accommodated therein.

The receptacle unit 12 is elongated generally along an axis, and has an accommodation portion 12*z* with a plurality of longitudinal open ended cavities 12*e* for receiving the male terminals 11. The receptacle unit 12 further has a socket part 12*h* defining a plug insertion hole 12*a* which communicates with the front end of the longitudinal cavities 12*e*. The socket part 12*h* has a top wall and a bottom wall apart from each other by a predetermined distance H1 which is greater than the socket height h1 of the conventional connector Cp (FIG. 7), and further has side walls extending between top and bottom walls. The male terminal 11 is retained in each of longitudinal cavities 12e such that a front end portion 11c of male terminal 11 protrudes into the plug insertion hole 12a. The socket part 12h is provided with a locking latch 12b formed on the front end of the top wall, and is further provided with a locking cavity 12c formed backside of the locking latch 12b.

Figure 3:
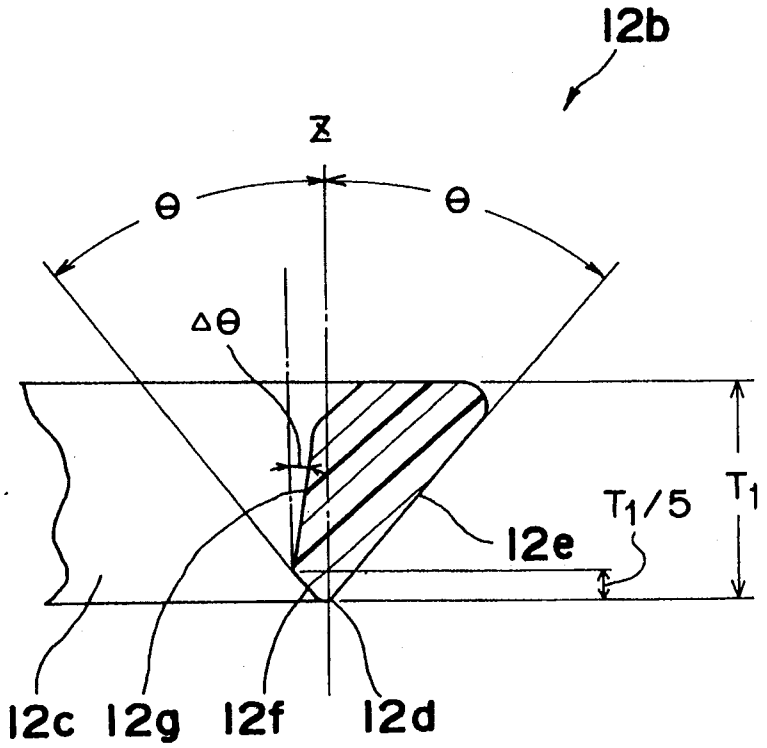
FIG. 3 is a side view showing a locking latch formed on the receptacle unit of FIG. 1.
Figure 7:
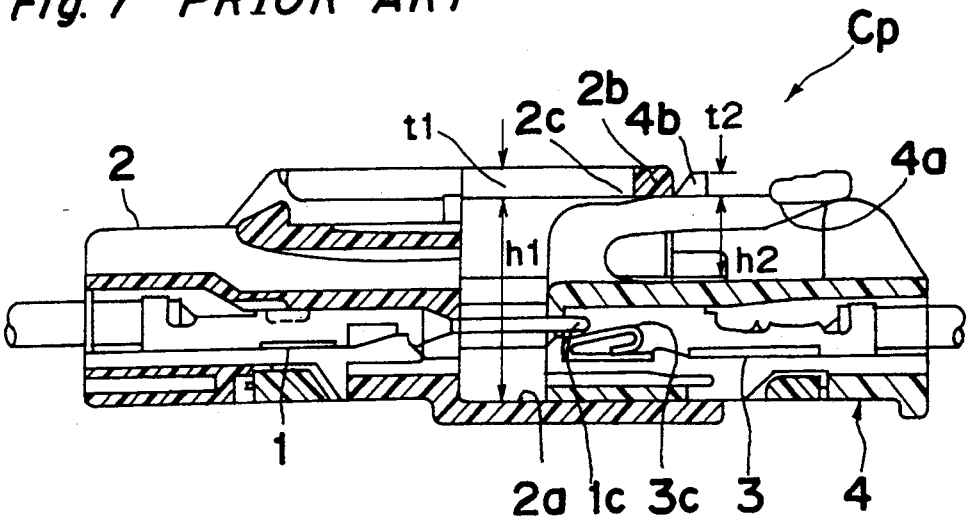
Fig. 7 PRIOR ART
FIG. 7 is a cross-sectional view showing conventional connector units which are just mated before engaging operation.
Figure 8:
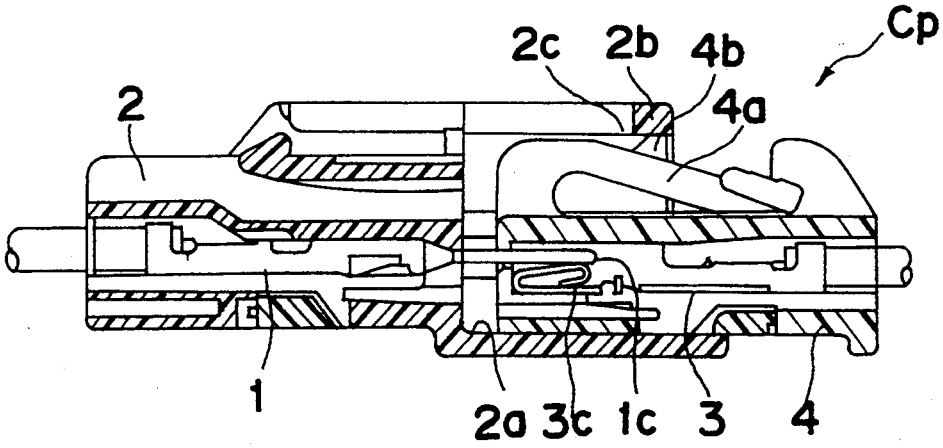
Fig. 8 PRIOR ART
FIG. 8 is a cross-sectional view showing the connector units of FIG. 7 which are temporarily engaged.
Figure 9:
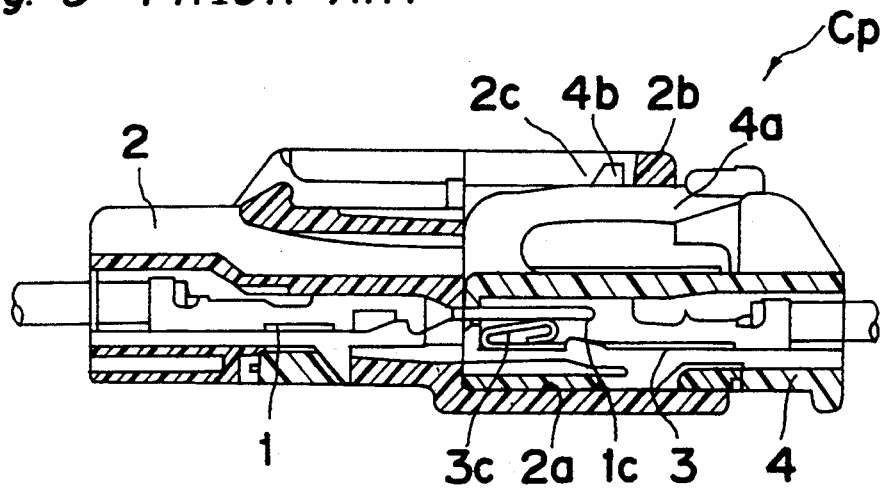
Fig. 9 PRIOR ART
FIG. 9 is a cross-sectional view showing the connector units of FIG. 7 which are completely engaged.

Referring to FIG. 3, the locking latch 12b on an enlarged scale is shown. The locking latch 12b is formed in a generally V-shaped configuration having a valley point 12d formed on the bottom thereof. The locking latch 12b has front and back tapered surfaces 12e and 12f diagonally rising up forward and backward, respectively, from the valley point 12d with a predetermined elevation angle $\theta$. More specifically, according to the present invention, the locking latch 12b is formed in such a manner that the angles $\theta$ contained between the vertical axis Z and either one of front and back tapered surfaces 12e and 12f are substantially the same (for example 50°). It is noted that the receptacle unit 12 elongates in the direction generally perpendicular to the vertical axis Z. The locking latch 12b extends vertically with a predetermined length T1 which is a height of the latch 12b. From an upper end of the back tapered surface 12f at position about one fifth of the latch height T1 above the valley point 12d, a back surface 12g rises up slightly inclining forward by a small angle $\Delta\theta$. The latch height T1 is greater than that t1 of the conventional connector (FIG. 7).

Referring back to FIG. 1, the plug unit 14 is elongated generally along an axis, and has an accommodation part 14z with a plurality of longitudinal open ended cavities 14e for receiving the female terminals 14. The receptacle unit 14 further has a cantilevered flexible arm 14a which extends from the front top end portion of the accommodation part 14z toward the rear along the elongating direction. The flexible arm 14a is located above the accommodation part 14z by a predetermined height H2 which is greater than the flexible arm height h2 (FIG. 7) of conventional connector Cp. The flexible arm 14a is provided with a locking ramp 14b vertically projecting from the upper surface thereof.

Figure 4:
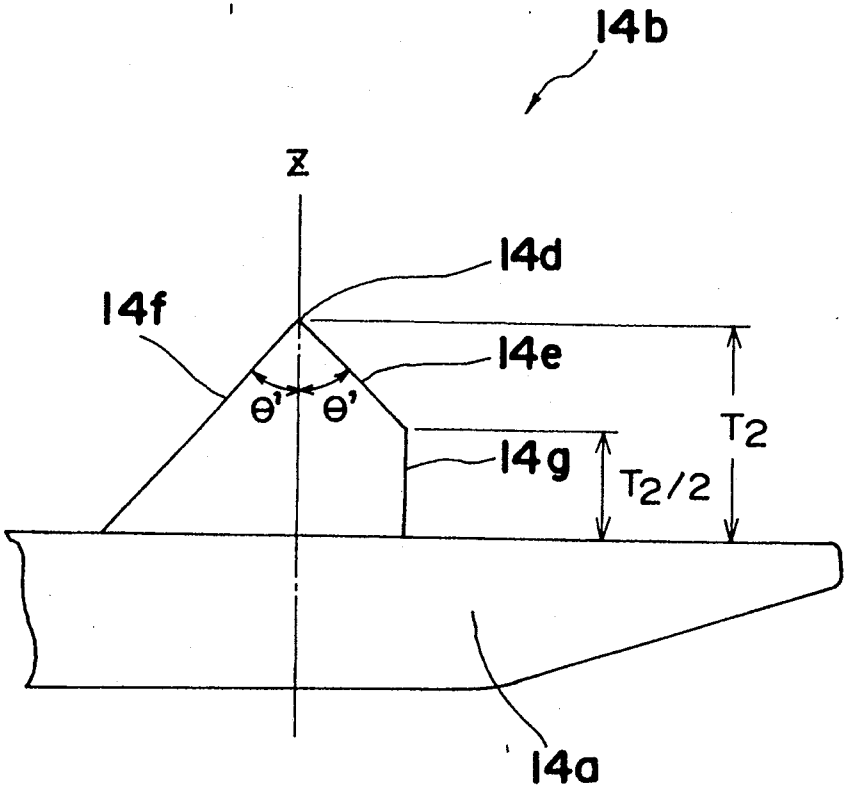
FIG. 4 is a side view showing a locking ramp formed on a flexible arm of the plug unit of FIG. 1.

Referring to FIG. 4, the locking ramp 14b on an enlarged scale is shown. The locking ramp 14b is formed in a generally inverted V-shaped configuration having a peak point 14d which is located above the flexible arm 14a by a predetermined length T2 which is a height of the locking ramp 14b. The ramp height T2 is greater than that t2 of the conventional connector Cp (FIG. 7). The locking ramp 14b has a front side tapered surface 14f diagonally rising up toward the free end of the flexible arm 14a along the elongated direction. From the peak point 14d, a backside tapered surface 14e also diagonally trails until the position about a half of ramp height T2 high above the flexible arm 14a. According to the present invention, the locking ramp 14b is formed in such a manner that the angles $\theta'$ contained between the vertical axis Z and either one of front side and backside tapered surfaces 14f and 14d are substantially the same (for example 50°). From the end of the backside tapered surface 14e, a backside surface 14g vertically extends to the upper surface of the flexible arm 14a.

Figure 5:
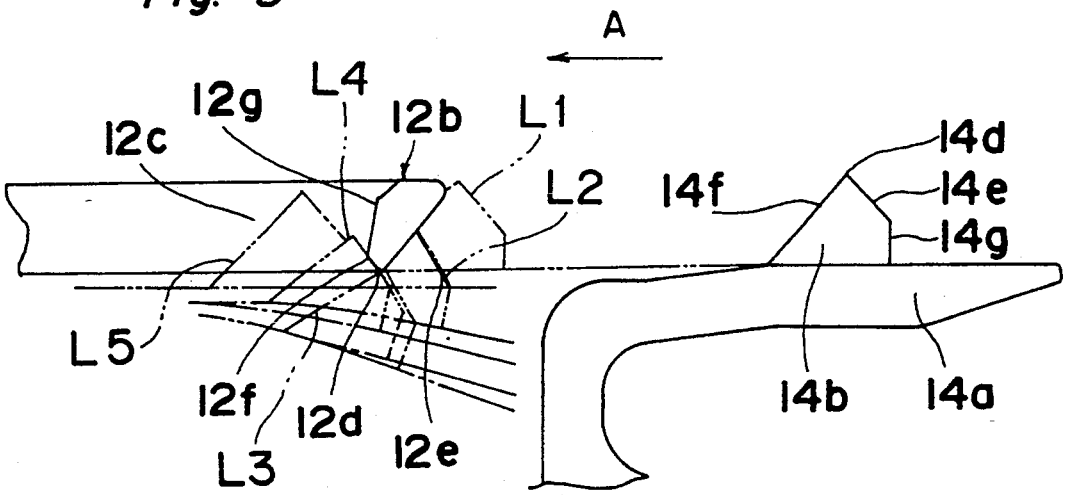
FIG. 5 is an illustration explaining the movement of the locking ramp during insertion of the plug unit to the receptacle units of FIG. 1, FIGS. 6A and 6B are graphs showing various forces observed during insertion of the plug unit to the receptacle unit shown in FIG. 1.

Referring to FIG. 5, the movement of the locking ramp 14b with respect to the locking latch 12b when the plug unit 14 is inserted to the plug insertion hole 12a of the receptacle unit 12 is shown. To make both connector units 12 and 14 engaged, the plug unit 14 is moved in an arrow direction A to be insert in to the plug insertion hole 12a along the elongated direction of the receptacle unit 12.

An imaginary line L1 shows the locking ramp 14b when the connector unit 14 is slidably received in the socket part 12h of the receptacle unit 12. In this position, the front side tapered surface 14f of the ramp 14 just contacts the back tapered surface 12e of the locking latch 12b, but the male terminal 11 does not contact the female terminal 13, as best shown in FIG. 1.

As the connector units 12 and 14 are moved longitudinally toward each other, the front side tapered surface 14f is pressed by the back tapered surface 12e so that the flexible arm 14b is deflected downward by the locking latch 12b, as shown by an imaginary line L2. Between the latch 12b and ramp 14b, a resistance force F for pressing the ramp 14b is produced. It is to be noted that this resistance force F acts to push out the plug unit 14 from the receptacle unit 12 in this case.

The resistance force F rapidly increases according to the mating operation of connector units 12 and 14 and reaches an maximum value, for example 77N, at a position where the peak point 14d of the ramp 14b is about to exceed the valley point 12d of latch 12b, as shown by an imaginary line L3. According to the present invention, it is arranged that the maximum value (for example 77N) of resistance force F is greater than a terminal insertion force (for example 32.5N) required for engaging mating terminals 11 and 13. It is to be noted that the value of resistance force F can be determined so as to have a value greater than that of the conventional connector based on comprehensive study of various factors such as latch height T1, inclination angles $\theta$ and $\theta'$, ramp height T2, arm height T1, and deflecting force depending on Young's modulus and bending strength of the connector materials.

When insertion operation is stopped before the peak point 14d exceeds the valley point 12d, the resistance force F having such a great resistance force as 77N, for example, acts to push out the plug unit 12 from the socket part 12h to a starting position (line L1). Since the terminals 11 and 13 are completely separated and nonconductive at the starting position, thus forcibly disengaged connectors can be easily detected by the quality inspection of the automobile, and it is possible to make the connector securely engaged.

Once the peak point 14d exceeds the valley point 12d, the flexible arm 14b resiliently rises up so that the peak point 14d enters the locking cavity 12c behind the locking latch 12b and the backside tapered surface 14e of the ramp 14b is opposed to the back tapered surface 12f of the latch 12b, as shown by an imaginary line L4. Even with the mating operation of connector units 12 and 14 at this position, the ramp 14b (14e) is supported by the latch 12b (12f) not to move toward the disengaging direction.

Furthermore, it is to be noted that the resistance force F acts in the reversed direction compared with the case before the peak point 14d exceeds the valley point 12d. In other words, the resistance force F acts to bias the plug unit 14 toward the socket part 12h of the receptacle unit 12. Therefore, the locking ramp 14b biased by the resistance force F automatically and completely enters into the locking cavity 12c and is locked thereat, as indicated by an imaginary line L5. At this locking position, the plug unit 14 is protected from accidental removal from the receptacle unit 12, because the backside surface 14*g* engages the back surface 12*g* even when the plug unit 14 is pulled.

Figure 6A:
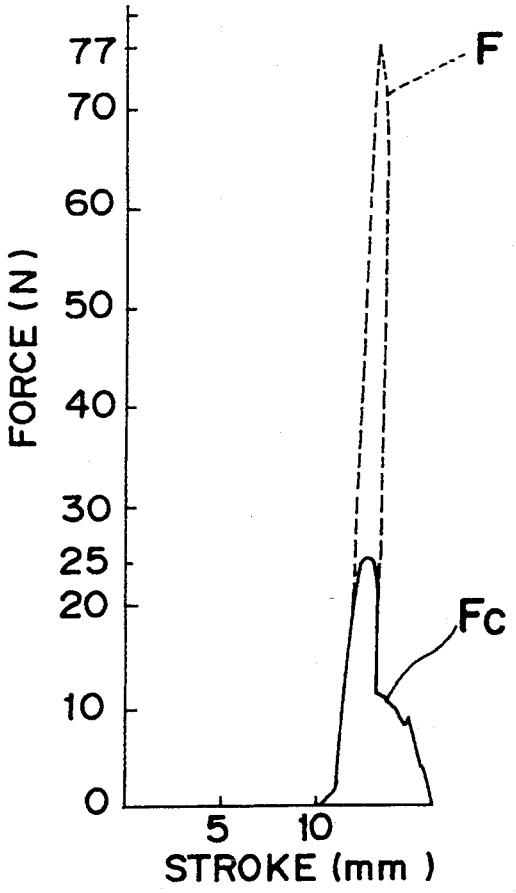

Referring to FIG. 6A, resistance forces observed during the mating operation of the connecter units are shown. The dot line represents the resistance force F occurring in the connector according to the present invention. The resistance force F steeply rises when the both mating units travel 10 mm (line L1 in FIG. 5), reaches the maximum value of about 77N at a position just before the peak 14*d* exceeds the valley 12*d* (line L3 in FIG. 5), steeply falls to about 10N at a position where the tapered surfaces 12*f* and 14*e* are engaged (Line L4 in FIG. 5), and then gradually reduces to zero at the engagement position (Line L5 in FIG. 5). However, a resistance force Fc of the conventional connectors Cp, indicated by the solid line, has the maximum value of about 25N, for example.

Figure 6B:
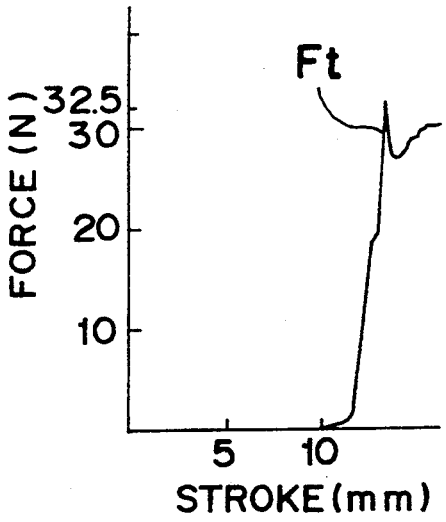

Referring to FIG. 6B, an insertion force Ft required for engaging the mating terminals 11 and 13 is shown. The insertion force Ft has a maximum value of about 32.5N. Thus, the connector C according to the present invention has a resistance force F much greater than insertion force Ft, when compared with the conventional connectors. The insertion force Ft is also a force retaining the terminals 11 and 13 as engaged when the terminals 11 and 13 are pulled to disengage. However, since the resistance force F is set at a value (77N) sufficiently greater than the insertion force Ft (32.5), the mating units 12 and 14 at temporarily engaged position are easily separated by the resistance force F.

As is clear from the foregoing description of the present invention, the connector forcibly separates the mating units by utilizing the resistance force produced between the mating units at a pre-engagement position again when the mating operation is stopped before the locking members of the mating units engage. Thus, the terminals are completely prevented from being temporarily engaged. Since the terminals are non-conductive at the pre-engagement position, it is possible to easily detect a forcibly disengaged connector through the inspection. Therefore, it is possible to prevent that temporarily engaged connectors from being installed in the automobiles and completely removed during the driving of the automobiles.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A connector for the connection of first and second connector members comprising:

flexible arm means provided on said first connector member, said flexible arm means being provided with first engaging means, said first engaging means having an inverted V-shaped cross-section with a first point at a top portion; and second engaging means provided on said second connector member, said second engaging means being engagable to said first engaging means, said second engaging means having a V-shaped cross-section with a second point at a lower portion, said first engaging means being movable between a first predetermined position, in which said first engaging means is pressed by said second engaging means to enable disengagement of said first connector member from said second connector member, when said first point is pressed to a position before said second point, and a second predetermined position, in which said first engaging means is pressed by said second engaging means to enable engagement of said first connector member with said second connector member, when said first point is pressed to a position beyond said second point, said second engaging means includes a back surface being inclined forwardly from a third point located above said second point towards said first engaging means when said first and second connector members are disengaged, said inclined back surface being able to contact said first engaging means when said first and second connector members are engaged.

2. A connector as claimed in claim 1, further comprising third engaging means provided on said second connector member, said first engaging means further being movable to a third predetermined position, in which said first engaging means is engaged with said third engaging means to lock said first and second connector members.

3. A connector as claimed in claim 1, wherein said first connector includes an accommodation part, said flexible arm means being deformed towards said accommodation part when said first point is pressed to a position before said second point.

* * * * *